US012584661B2

(12) United States Patent
Fox et al.

(10) Patent No.: US 12,584,661 B2
(45) Date of Patent: Mar. 24, 2026

(54) FREE COOLING SYSTEM FOR LOW AMBIENT TEMPERATURES

(71) Applicant: TRANE INTERNATIONAL INC., Davidson, NC (US)

(72) Inventors: William B. Fox, Onalaska, WI (US); Jacob L. Gregg, Pueblo, CO (US); Robert J. Larrinaga, Pueblo West, CO (US); Todd Duncan, La Crosse, WI (US); Daryl Keys, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 29 days.

(21) Appl. No.: 18/536,963

(22) Filed: Dec. 12, 2023

(65) Prior Publication Data

US 2025/0189177 A1 Jun. 12, 2025

(51) Int. Cl.

| | |
|---|---|
| ***F25B 13/00*** | (2006.01) |
| ***F25B 29/00*** | (2006.01) |
| ***F25B 41/20*** | (2021.01) |
| ***F25B 41/40*** | (2021.01) |

(52) U.S. Cl.

CPC ..... *F25B 13/00* (2013.01); *F25B 29/003* (2013.01); *F25B 41/20* (2021.01); *F25B 41/40* (2021.01)

(58) Field of Classification Search

CPC ..... F25B 13/00; F25B 41/20; F25B 41/40; F25B 29/003

See application file for complete search history.

(56) References Cited

U.S. PATENT DOCUMENTS

| | | | | |
|---|---|---|---|---|
| 11,199,356 | B2 | 12/2021 | Kopko et al. | |
| 2010/0242532 | A1 | 9/2010 | Kopko et al. | |
| 2019/0186801 | A1* | 6/2019 | Kopko | F25B 49/027 |
| 2022/0307747 | A1* | 9/2022 | Jovet | F24F 11/84 |

OTHER PUBLICATIONS

Extended European Search Report, European Patent Application No. 24218773.0, Apr. 14, 2025 (8 pages).

* cited by examiner

*Primary Examiner* — Larry L Furdge
(74) *Attorney, Agent, or Firm* — HSML P.C.

(57) ABSTRACT

A free cooling system includes a circulation path including a pump and one or more heaters. The pump is configured to circulate a process fluid when the free cooling system is deactivated, and the one or more heaters are configured to add heat to the process fluid in the circulation path such that the process fluid remains above a freezing temperature of said process fluid.

14 Claims, 3 Drawing Sheets

FREE COOLING SYSTEM FOR LOW AMBIENT TEMPERATURES

FIELD

This disclosure is directed to free cooling systems for heating, ventilation, air conditioning, and refrigeration (HVACR) systems, particularly for HVACR systems to be used in low ambient temperature areas.

BACKGROUND

Free cooling systems can circulate a process fluid to be cooled by ambient temperatures to provide or supplement cooling provided by a heating, ventilation, air conditioning, and refrigeration (HVACR) system. The free cooling system can be activated as needed. When the free cooling system is deactivated, at least some of the process fluid can remain in the heat exchanger where the process fluid is cooled by the ambient temperature.

SUMMARY

This disclosure is directed to free cooling systems for heating, ventilation, air conditioning, and refrigeration (HVACR) systems, particularly for HVACR systems to be used in low ambient temperature areas.

By heating and continuing to circulate the process fluid of the free cooling system when the free cooling system is deactivated, freezing of the process fluid can be prevented even when the free cooling system is deactivated at low ambient temperatures. By preventing freezing, water can be used as the process fluid without requiring the addition of or use entirely of anti-freezing compounds such as glycol. This can significantly reduce the use of glycol, which is a hazardous material, improving the environmental and health safety of HVACR systems using a free cooling system according to embodiments. This in turn allows broader use of free cooling systems, improving energy efficiency for HVACR systems by utilizing ambient conditions in addition to mechanical cooling to achieve desired temperatures and satisfaction of the various loads on the HVACR system. Using a plurality of heaters can ensure sufficient heating across the free cooling system to avoid localized freezing of the process fluid. Having headers for the process fluid when it is distributed to heat exchange coils can simplify the piping arrangement and further enable consistent and sufficient heating so as to avoid freezing of the process fluid.

In an embodiment, a free cooling system includes a circulation path. The circulation path includes one or more outdoor heat exchangers of the free cooling system, a pump, and one or more heaters. The pump and the one or more heaters configured to operate when the free cooling system is deactivated.

In an embodiment, the free cooling system further includes one or more isolation valves configured to isolate the circulation path from a free cooling flow path of the free cooling system when the free cooling system is deactivated.

In an embodiment, the circulation path includes a plurality of the outdoor heat exchangers of the free cooling system and an outlet header configured to receive process fluid from each of the plurality of outdoor heat exchangers. In an embodiment, at least some of the one or more heaters are disposed in the outlet header.

In an embodiment, the circulation path includes a plurality of the outdoor heat exchangers of the free cooling system and an inlet header configured to distribute process fluid to each of the plurality of outdoor heat exchangers. In an embodiment, at least some of the one or more heaters are disposed in the inlet header.

In an embodiment, the free cooling system further includes a temperature sensor provided in the circulation path and a controller configured to control the one or more heaters such that a process fluid in the circulation path is maintained at a temperature greater than a freezing temperature of the process fluid. In an embodiment, the temperature sensor is downstream of the one or more outdoor heat exchangers with respect to flow of the process fluid in the circulation path.

In an embodiment, a method of operating a free cooling system includes, when the free cooling system is in a deactivated state, circulating at least some of a process fluid of the free cooling system through a circulation path. The circulation path includes one or more outdoor heat exchangers of the free cooling system, a pump, and one or more heaters. The method further includes operating the one or more heaters to heat the at least some of the process fluid.

In an embodiment, the method further includes closing one or more isolation valves such that the circulation path is isolated from a free cooling flow path of the free cooling system. In an embodiment, closing the one or more isolation valves is performed when the free cooling system is deactivated from an activated state.

In an embodiment, the method further includes detecting a temperature of the process fluid in the circulation path using a temperature sensor, and wherein the operating of the one or more heaters is based on the temperature detected in the circulation path. In an embodiment, the operating of the one or more heaters is further based on an ambient temperature of the free cooling system.

DRAWINGS

DETAILED DESCRIPTION

This disclosure is directed to free cooling systems for heating, ventilation, air conditioning, and refrigeration (HVACR) systems, particularly for HVACR systems to be used in low ambient temperature areas.

Figure 1:
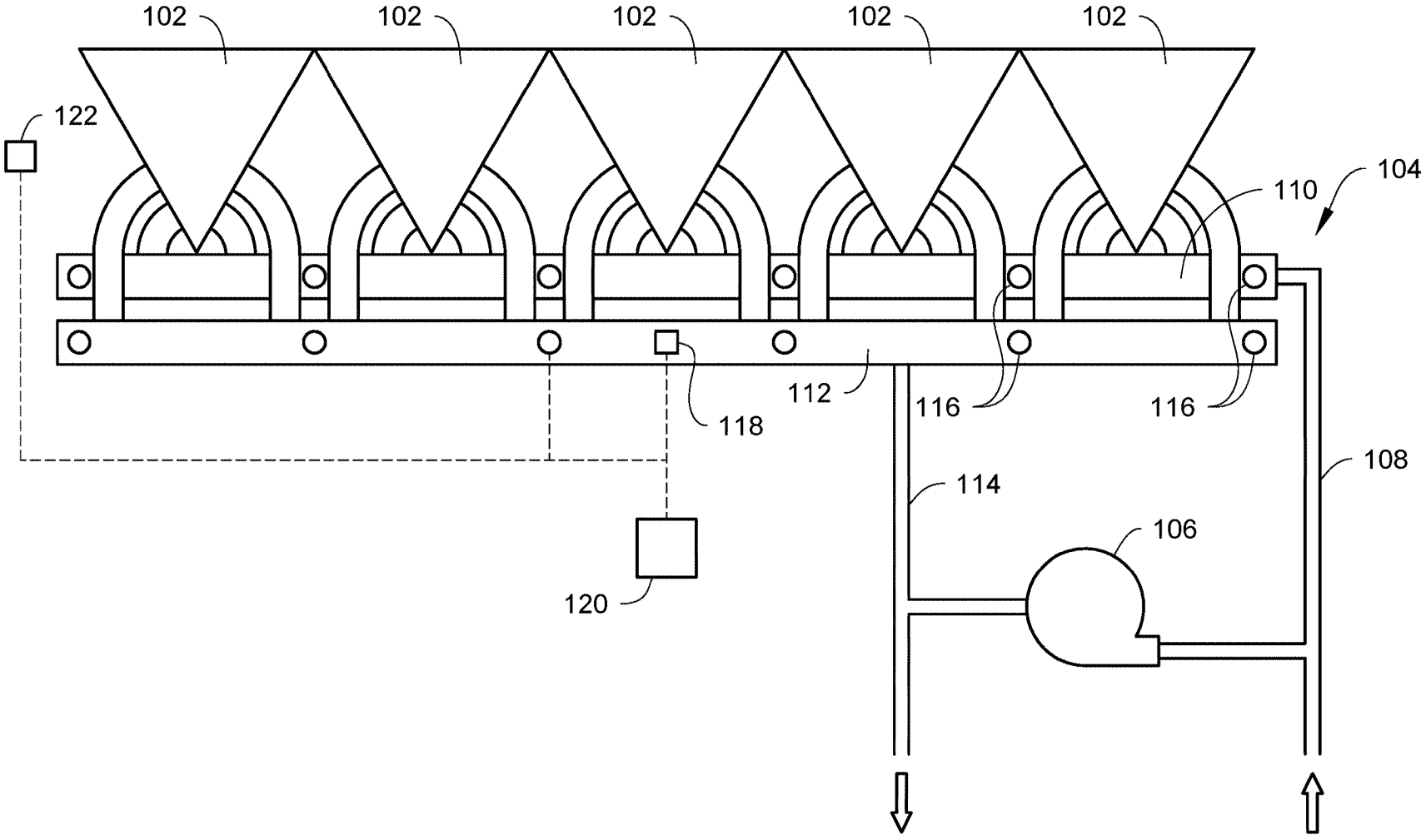
FIG. 1 shows a piping arrangement for a free cooling system according to an embodiment.

FIG. 1 shows a piping arrangement for a free cooling system according to an embodiment. Free cooling system 100 includes one or more heat exchangers 102. Free cooling system 100 further includes a flow path 104 including a pump 106, a distribution pipe 108, an inlet header 110, an outlet header 112, and a return pipe 114. Free cooling system 100 further includes at least one heater 116, optionally at least one temperature sensor 118, and a controller 120. In an embodiment, free cooling system 100 further optionally includes an ambient temperature sensor 122.

Free cooling system 100 is a portion of a hydronic system of a heating, ventilation, air conditioning, and refrigeration (HVACR) system configured to cool the process fluid of the hydronic system by enabling exchange of heat with the ambient environment. The process fluid can be any suitable process fluid usable as a media for heat transfer, such as water, glycol, combinations thereof, and the like. In an embodiment, the process fluid is water. In an embodiment, the process fluid does not include glycol. In an embodiment, the process fluid is water and does not include any anti-freezing compound. Free cooling system 100 can be selectively used to cool the process fluid, based on, for example, the ability to cool the process fluid, heating or cooling demands being serviced by the HVACR system, or the like, and can be deactivated when not used to cool the process fluid. Free cooling system 100 can also be referred to as a water-side economizer or any other suitable term for a system configured to cool the process fluid of the hydronic system by enabling exchange of heat with the ambient environment.

Free cooling heat exchanger(s) 102 are one or more heat exchangers configured to allow the process fluid to exchange heat with the ambient environment so as to cool the process fluid. The free cooling heat exchanger(s) can be any suitable heat exchangers positioned such that the process fluid exchanges heat with the ambient environment. The free cooling heat exchanger(s) 102 can be included in any suitable position in the HVACR system including free cooling system 100, such as being located at or near outdoor heat exchange coils of the working fluid circuit of the HVACR system.

Flow path 104 is a flow path provided in free cooling system 100 for circulation of process fluid when the free cooling system 100 is in a deactivated state, and optionally further when ambient conditions present a risk of freezing the process fluid. The flow path 104 circulates process fluid through the free cooling heat exchanger(s) 102 and the other portions of flow path 104 to prevent the freezing of process fluid in the free cooling heat exchanger(s) 102 or in the fluid lines connecting thereto. In an example of flow path 104, pump 106 is provided in flow path 104 to drive the process fluid such that the process fluid circulates within flow path 104. Pump 106 can be any suitable pump for driving the process fluid through flow path 104. Distribution pipe 108 is a fluid line configured to convey the process fluid from pump 106 to inlet heater 110. Inlet header 110 is configured to receive the process fluid from distribution pipe 108 and to distribute the process fluid to the free cooling heat exchanger(s) 102. Outlet header 112 is configured to receive the process fluid from the one or more free cooling heat exchanger(s) 102. Outlet header 112 is configured to direct the received process fluid to return pipe 114, which is configured to direct the process fluid to pump 106. While inlet header 110 and outlet header 112 are shown as being below the free cooling heat exchanger(s) 102 in FIG. 1, it is understood that inlet header 110 and outlet header 112 can be provided in any suitable position relative to one another and to the free cooling heat exchanger(s) 102 such that the inlet header 110 can distribute process fluid to the free cooling heat exchanger(s) 102 and the outlet header 112 can receive process fluid from the free cooling heat exchanger(s) 102. Flow path 104 can be connected to other parts of a hydronic system such that flow can pass from the other parts of the hydronic system to the distribution pipe 108 in some operating modes, and that flow can pass from the return pipe 114 to other parts of the hydronic system in some operating modes.

One or more heater(s) 116 can be provided along the flow path 104. The heater(s) 116 can each be any suitable heater configured to add heat to the process fluid flowing through flow path 104, such as an electric heater. The heaters 116 shown in FIG. 1 are provided in the inlet header 110 and outlet header 112, however in embodiments one or more heater(s) 116 can be provided in any of distribution pipe 108, inlet header 110, outlet header 112, return pipe 114, or any combination thereof.

Temperature sensor 118 can be disposed along the flow path 104 such that a temperature of the process fluid within flow path 104 can be determined. Temperature sensor 118 can be at any suitable position along flow path 104. In an embodiment, the temperature sensor 118 can be disposed along the return pipe 114, for example at or near an inlet of the pump 106. The temperature sensor 118 can provide a temperature reading for the process fluid to the controller 120.

Controller 120 can be configured to control the use of flow path 104 and the elements thereof. The controller 120 can receive a temperature reading from one or more temperature sensor(s) 118 disposed along flow path 104. Controller 120 can control the operation of the heater(s) 116 such that the process fluid in flow path 104 is maintained above a freezing temperature of said process fluid. The controller 120 can optionally further control a flow rate provided by the pump 106. In an embodiment, the controller 120 can further control the utilization of flow path 104, for example by controlling the use of isolation valves configured to separate the flow path 104 from a remainder of free cooling system 100. An example of such isolation valves are isolation valves 212 shown in FIG. 2 and described below.

Ambient temperature sensor 122 can optionally be included in the free cooling system 100. The ambient temperature sensor 122 can be a temperature sensor provided in any suitable position to measure the ambient outdoor temperature at or near the HVACR system including free cooling system 100. Ambient temperature sensor 122 can provide an ambient temperature reading to controller 120 or to another controller. Temperature readings from ambient temperature sensor 122 can be used to determine if a risk of freezing of the process fluid exists. In an embodiment, the flow path 104 can be used when the free cooling system 100 is in a deactivated state and the ambient temperature reading indicates a risk of freezing of the process fluid.

Figure 2:
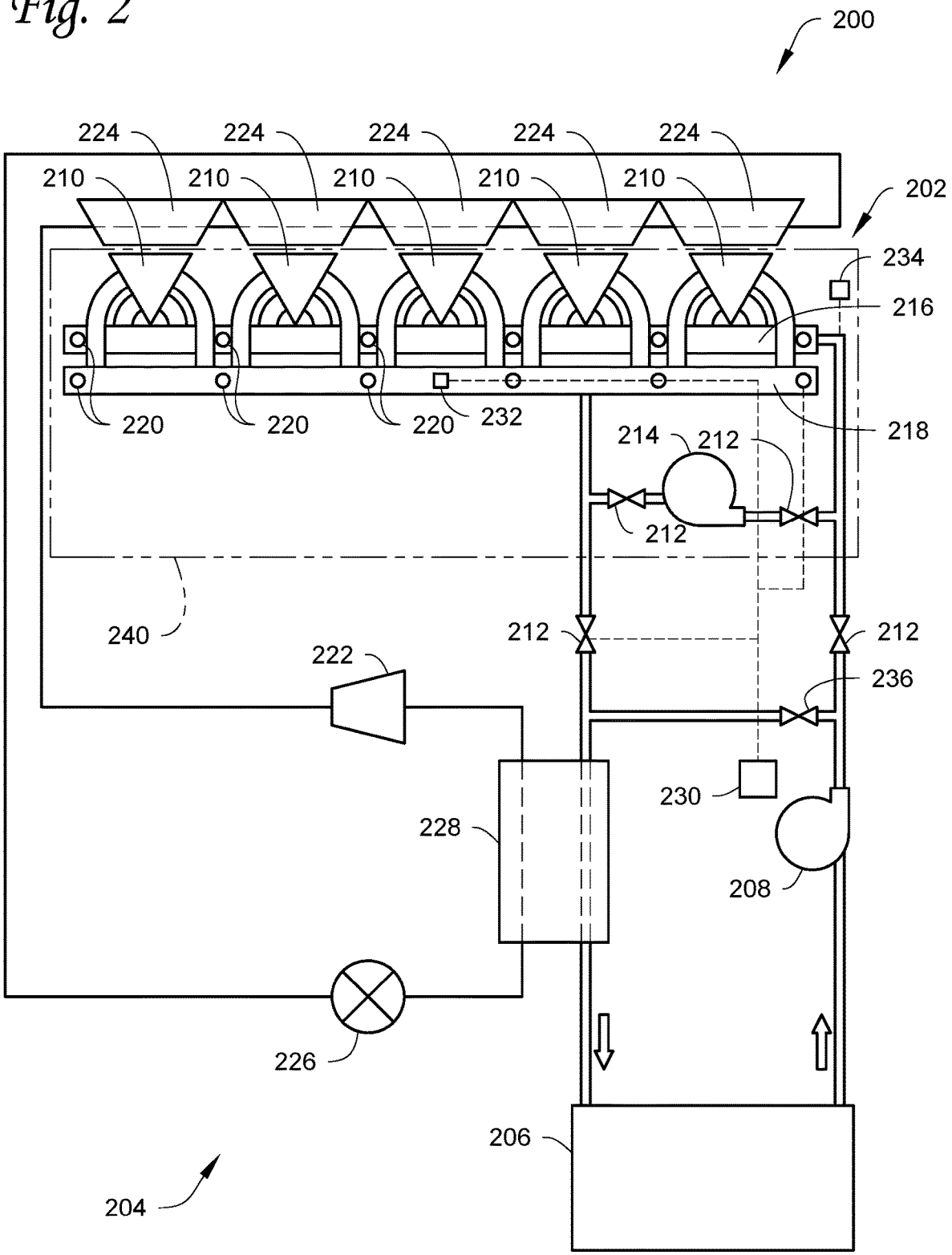
FIG. 2 shows a hydronic system including a free cooling system according to an embodiment.

FIG. 2 shows a hydronic system including a free cooling system according to an embodiment. Hydronic system 200 includes a free cooling system 202 and a mechanical thermal system 204. Hydronic system 200 circulates a process fluid to a load 206. Hydronic system 200 includes one or more pumps 208. The free cooling system 202 includes one or more free cooling heat exchangers 210, isolation valves 212, pump 214, inlet header 216, outlet header 218, and one or more heaters 220. Mechanical thermal system 204 includes compressor 222, first heat exchanger 224, expander 226, and second heat exchanger 228. Hydronic system 200 can further include a controller 230, one or more temperature sensors 232, and/or one or more ambient temperature sensors 234.

Hydronic system 200 is configured to provide cooling to load 206 by circulating a process fluid. The process fluid can be cooled at mechanical thermal system 204 by exchange of heat between the process fluid and a working fluid of the mechanical thermal system 204 at second heat exchanger 228. The cooled process fluid can then be provided to load 206 to absorb heat at load 206, thereby providing cooling to load 206. Hydronic system 200 can include one or more pumps 208 configured to drive circulation of the process fluid through the hydronic system 200. The process fluid can be any suitable process fluid usable as a media for heat transfer, such as water, glycol, combinations thereof, and the like. In an embodiment, the process fluid is water. In an embodiment, the process fluid does not include glycol. In an embodiment, the process fluid is water and does not include any anti-freezing compound.

The free cooling system 202 is configured to allow the process fluid to exchange heat with the ambient environment so as to cool the process fluid, thereby cooling the fluid circulating to load 206. The free cooling system 202 includes one or more free cooling heat exchangers 210 configured to allow the exchange of heat between process fluid contained therein and the ambient environment. The free cooling heat exchanger(s) 210 can be located alongside or within a same structure as first heat exchanger 224 of the mechanical thermal system 204. The free cooling system 202 can include suitable fluid connections and piping to allow process fluid to flow to and from the one or more free cooling heat exchangers 210. Free cooling system 202 can include an inlet header 216 configured to receive the process fluid and distribute the process fluid to the one or more free cooling heat exchangers 210. Free cooling system 202 can further include an outlet header 218 configured to receive the process fluid leaving the one or more free cooling heat exchangers 210.

Free cooling system 202 is configured such that a thermal maintenance flow path 240 can be selectively formed in the free cooling system 202. The thermal maintenance flow path 240 can be selectively formed, for example, when the free cooling system 202 is not being used to provide cooling to the process fluid and when the temperature conditions provide a risk of the process fluid freezing in the free cooling heat exchangers 210. The thermal maintenance flow path 240, when formed, includes the free cooling heat exchangers 210. In an embodiment, the thermal maintenance flow path 240 can be formed by operation of isolation valves 212. Isolation valves 212 can be any suitable valves, such as two- or three-way valves or combinations of such valves that are positioned and configured so as to separate the thermal maintenance flow path 240 from the remainder of hydronic system 200. Thermal maintenance flow path 240 includes a pump 214 configured to circulate the portion of process fluid included in the thermal maintenance flow path 240 when the thermal maintenance flow path 240 is formed. Pump 214 can be any suitable type of pump. At least some of the isolation valves 212 can further be configured to separate the free cooling system 202 from other parts of the fluid circuit of hydronic system 200, for example when the free cooling system 202 is in a deactivated state. The one or more heaters 220 can each be any suitable heater configured to add heat to the process fluid flowing through the thermal maintenance flow path 240, such as an electric heater. The one or more heaters 220 can be positioned at any suitable position along the thermal maintenance flow path 240, for example in inlet header 216, outlet header 218, or any fluid lines included in the thermal maintenance flow path 240.

Mechanical thermal system 204 can be configured to adjust a temperature of the process fluid being circulated within hydronic system 200. Mechanical thermal system 204 can include a working fluid circuit configured to circulate a working fluid. The working fluid circuit can include compressor 222 configured to compress the working fluid. The compressor 222 can be any suitable compressor for compressing the working fluid. Working fluid from the compressor 222 can pass to first heat exchanger 224. At first heat exchanger 224, the working fluid can reject heat to the ambient environment. The first heat exchanger 224 can include, for example, one or more cooling coils. First heat exchanger 224 can be located at or near the free cooling heat exchangers 210. Working fluid can pass from the first heat exchanger 224 to expander 226. Expander 226 can be any suitable expander for expanding the working fluid such as one or more expansion valves, one or more expansion orifices, one or more orifice plates, and the like. The working fluid can pass from expander 226 to second heat exchanger 228. Second heat exchanger 228 can be configured to allow the expanded working fluid to exchange heat with the process fluid of hydronic system 200. When free cooling system 202 is deactivated, valve 236 can permit flow to allow circulation of process fluid from second heat exchanger 228 to the load 206 without requiring flow through the free cooling system 202.

Controller 230 is configured to control at least portions of the hydronic system 200. In an embodiment, controller 230 is configured to determine when a thermal maintenance flow path 240 of free cooling system 202 is to be used. In an embodiment, controller 230 is configured to determine whether free cooling system 202 is to be activated to provide free cooling or is to be deactivated. In an embodiment, controller 230 is configured to control isolation valves 212 so as to define a thermal maintenance flow path 240 within the free cooling system 202. In an embodiment, controller 230 is configured to control pump 214 to control a rate of flow through free cooling system 202, for example when the thermal maintenance flow path 240 is defined by the isolation valves 212. In an embodiment, controller 230 is configured to control the one or more heaters 220. In an embodiment, control of the one or more heaters is based at least in part on a temperature reading of the process fluid. In an embodiment, control of the one or more heaters is based at least in part on an ambient temperature. Controller 230 can be configured to control the one or more heaters 220 to maintain a temperature of process fluid in the thermal maintenance flow path 240 above a freezing temperature of said process fluid. Controller 230 can be connected to any suitable one or more of isolation valves 212, pump 214, and/or heater(s) 220 so as to control the respective elements of hydronic system 200. In an embodiment, controller 230 can be connected to and configured to control other elements of or connected to hydronic system 200, such as pump(s) 208, mechanical thermal system 204 or elements thereof, and the like.

Hydronic system 200 can include one or more temperature sensors 232 configured to obtain a temperature reading for the process fluid. The temperature sensor(s) 232 can be disposed at any suitable position along the fluid lines and elements of hydronic system 200. In an embodiment, at least one of more of the temperature sensor(s) 232 can be disposed at outlet header 218, between outlet header 218 and pump 214 with respect to flow through the thermal maintenance flow path 240, or at an inlet of pump 214. The temperature sensor(s) 232 can be connected to controller 230 such that the temperature sensor(s) can report the temperature readings for the process fluid to the controller 230, for example for use in controlling the one of more heaters 220.

Hydronic system 200 can further include one or more ambient temperature sensors 234. The ambient temperature sensor(s) 234 can be provided in any suitable position to measure the ambient outdoor temperature at or near the HVACR system hydronic system 200. Ambient temperature sensor(s) 234 can provide an ambient temperature reading to controller 230 or to another controller. Temperature readings from ambient temperature sensor(s) 234 can be used to determine if a risk of freezing of the process fluid exists, for example when the ambient temperature is below a threshold temperature such as a freezing point of the process fluid. In an embodiment, the ambient temperature sensor(s) 234 can be connected to controller 230 such that the ambient temperature sensor(s) 234 can report the temperature readings for the ambient environment to the controller 230, for example for use in determining when to form or utilize the thermal maintenance flow path 240, control of the one or more heaters 220, or the like.

Figure 3:
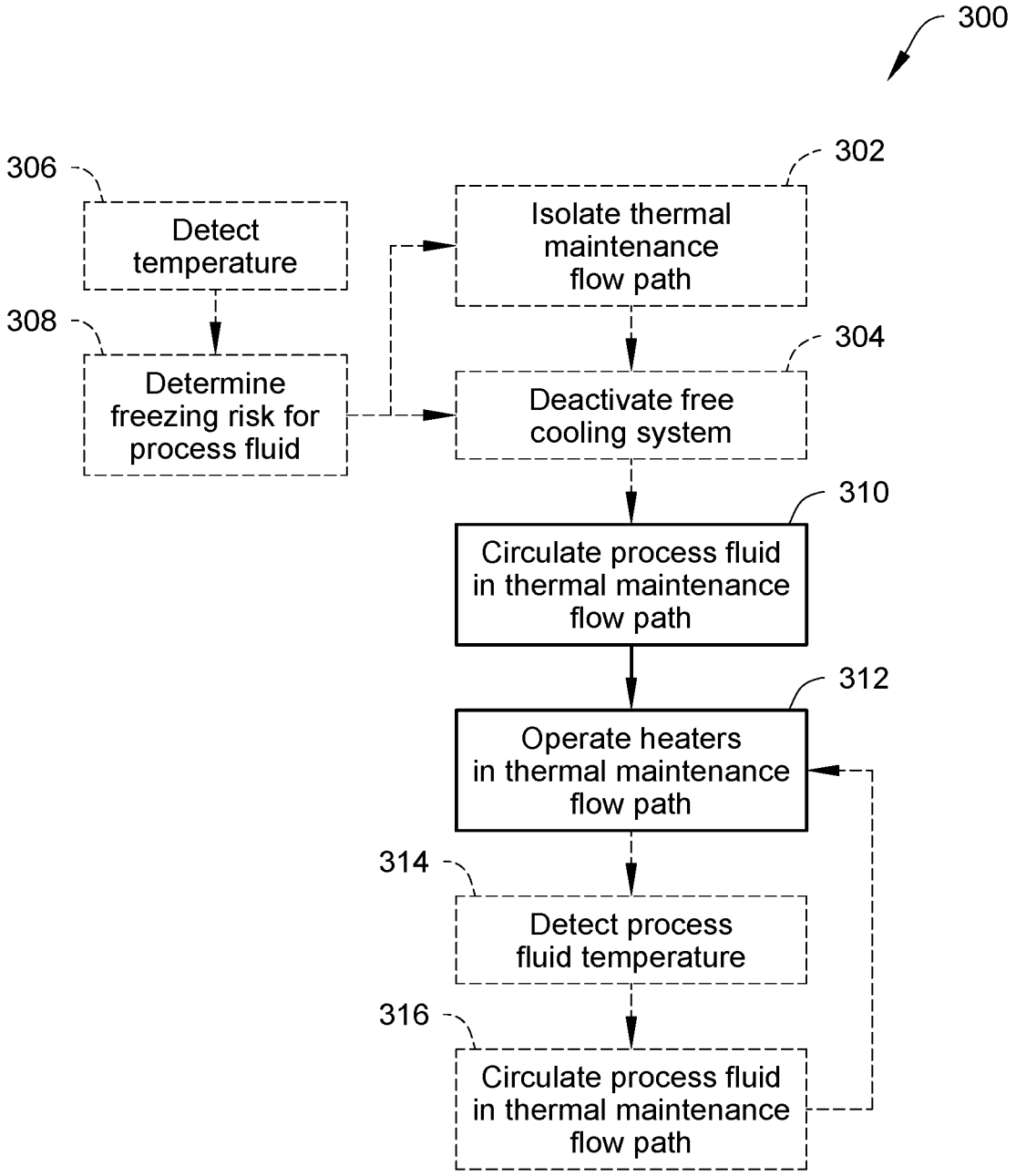
FIG. 3 shows a flowchart of operating a free cooling system according to an embodiment.

FIG. 3 shows a flowchart of operating a free cooling system according to an embodiment. Method 300 optionally includes closing one or more isolation valves to isolate a thermal maintenance flow path from a free cooling flow path 302. Method 300 can optionally include deactivating the free cooling system 304. Method 300 can optionally include detecting a temperature 306 and determining a freezing risk of a process fluid 308. Method 300 includes using a pump to circulate process fluid within the thermal maintenance flow path 310 when the free cooling system is deactivated. The method 300 further includes operating one or more heaters disposed along the thermal maintenance flow path 312. The method 300 can further optionally include detecting a process fluid temperature at 314 and adjusting the operation of the one or more heaters based on the detected process fluid temperature at 316.

In an embodiment, method 300 includes closing one or more isolation valves to isolate a thermal maintenance flow path from a free cooling flow path 302. The thermal maintenance flow path is a flow path for circulation of at least a portion of the process fluid such that the process fluid is maintained above a freezing temperature thereof. The thermal maintenance flow path can be, for example, flow path 104 as shown in FIG. 1 and described above. The isolation valves can be closed ahead of deactivating the free cooling system 304, when a risk of freezing of the process fluid is detected while the free cooling system is deactivated, or at any other suitable initiation of use of the thermal maintenance flow path.

In an embodiment, the free cooling system can be deactivated at 304. The free cooling system can be deactivated when, for example, ambient conditions do not support efficient free cooling, when system demands do not require free cooling, or any other suitable criteria for the deactivation of the free cooling system. In the deactivated state, the process fluid is not circulated to the load serviced by the free cooling system.

In an embodiment, the method 300 can include detecting a temperature at 306. The temperature can include one or both of a temperature of the process fluid and/or an ambient temperature. The temperature detected at 306 can be used to determine a freezing risk of a process fluid 308. The freezing risk can be determined when a temperature of the process fluid approaches a freezing point such as falling below a threshold value, when the ambient temperature is below or at a freezing point of the process fluid, combinations of the process fluid temperature and the ambient temperature indicate a freezing risk, or the like. In an embodiment, when the freezing risk is determined to be present at 308, the thermal maintenance flow path can be utilized when the free cooling system is in a deactivated state.

Method 300 includes using a pump to circulate process fluid within the thermal maintenance flow path 310. The thermal maintenance flow path can be, for example, flow path 104 shown in FIG. 1 and described above. The pump can be any suitable pump, such as pump 106 shown in FIG. 1 and described above. The thermal maintenance flow path includes the free cooling heat exchangers where the process fluid exchanges heat with the ambient environment. In an embodiment, the thermal maintenance flow path includes a portion of the process fluid of the hydronic system including the free cooling system performing the method 300.

Method 300 further includes operating one or more heaters disposed along the thermal maintenance flow path 312. The one or more heaters can be any suitable heaters, such as electric heaters. The one or more heaters can be disposed at any suitable point along the thermal maintenance flow path, for example at one or more of distribution pipe 108, inlet header 110, outlet header 112, return pipe 114, or any combination thereof as shown in FIG. 1 and described above. The one or more heaters are operated at 312 such that the heater(s) add heat to the process fluid circulating within the thermal maintenance flow path. The one or more heaters can be operated such that the process fluid is maintained above a freezing point of said process fluid. While reference is made to components of the system of FIG. 1, it is understood that the method can be implemented using the corresponding elements as shown in FIG. 2 and discussed above.

In an embodiment, method 300 can further include detecting a process fluid temperature at 314. The detection of the process fluid temperature at 314 can be performed using a temperature sensor disposed along the thermal maintenance flow path, for example temperature sensor 118 shown in FIG. 1 and described above. In an embodiment, method 300 includes adjusting the operation of the one or more heaters based on the detected process fluid temperature at 316. The adjustment of the operation of the one or more heaters can be to increase or decrease the heat output of the one or more heaters to the process fluid. For example, when the process fluid is at or near the freezing temperature, for example being below a threshold temperature, the amount of heat output from the one or more heaters can be increased to raise the temperature of the process fluid so as to ensure that the process fluid does not freeze. In an embodiment, when the process fluid is at a temperature indicative of no or low risk of freezing, for example by being above a threshold temperature or exceeding the freezing point by a predetermined amount, the one or more heaters can be turned off or having the heat output reduced, for example to conserve energy.

Aspects

It is understood that any of aspects 1-8 can be combined with any of aspects 9-13.

Aspect 1. A free cooling system, comprising a circulation path, the circulation path comprising one or more outdoor heat exchangers of the free cooling system, a pump, and one or more heaters, the pump and the one or more heaters configured to operate when the free cooling system is deactivated.

Aspect 2. The free cooling system according to aspect 1, further comprising one or more isolation valves configured to isolate the circulation path from a free cooling flow path of the free cooling system when the free cooling system is deactivated.

Aspect 3. The free cooling system according to any of aspects 1-2, wherein the circulation path includes a plurality of the outdoor heat exchangers of the free cooling system and an outlet header configured to receive process fluid from each of the plurality of outdoor heat exchangers.

Aspect 4. The free cooling system according to aspect 3, wherein at least some of the one or more heaters are disposed in the outlet header.

Aspect 5. The free cooling system according to any of aspects 1-4, wherein the circulation path includes a plurality of the outdoor heat exchangers of the free cooling system and an inlet header configured to distribute process fluid to each of the plurality of outdoor heat exchangers.

Aspect 6. The free cooling system according to aspect 5, wherein at least some of the one or more heaters are disposed in the inlet header.

Aspect 7. The free cooling system according to any of aspects 1-6, further comprising a temperature sensor provided in the circulation path and a controller configured to control the one or more heaters such that a process fluid in the circulation path is maintained at a temperature greater than a freezing temperature of the process fluid.

Aspect 8. The free cooling system according to aspect 7, wherein the temperature sensor is downstream of the one or more outdoor heat exchangers with respect to flow of the process fluid in the circulation path.

Aspect 9. A method of operating a free cooling system, comprising:

when the free cooling system is in a deactivated state, circulating at least some of a process fluid of the free cooling system through a circulation path including one or more outdoor heat exchangers of the free cooling system, a pump, and one or more heaters, and operating the one or more heaters to heat said at least some of the process fluid.

Aspect 10. The method according to aspect 9, further comprising closing one or more isolation valves such that the circulation path is isolated from a free cooling flow path of the free cooling system.

Aspect 11. The method according to aspect 10, wherein closing the one or more isolation valves is performed when the free cooling system is deactivated from an activated state.

Aspect 12. The method according to any of aspects 9-11, further comprising detecting a temperature of the process fluid in the circulation path using a temperature sensor, and wherein the operating of the one or more heaters is based on the temperature detected in the circulation path.

Aspect 13. The method according to aspect 12, wherein the operating of the one or more heaters is further based on an ambient temperature of the free cooling system.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A free cooling system, comprising:

a circulation flow path containing a process fluid, the circulation flow path including:

one or more outdoor heat exchangers of the free cooling system, a pump, and one or more heaters, wherein the pump and the one or more heaters are configured to operate and circulate at least some of the process fluid through the one or more outdoor heat exchangers when the free cooling system is deactivated.

2. The free cooling system of claim 1, further comprising:

a free cooling flow path including the one or more outdoor heat exchangers; and one or more isolation valves configured to isolate the circulation flow path from the free cooling flow path when the free cooling system is deactivated.

3. The free cooling system of claim 1, wherein the circulation flow path includes a plurality of the outdoor heat exchangers of the free cooling system and an outlet header configured to receive the process fluid from each of the plurality of outdoor heat exchangers.

4. The free cooling system of claim 3, wherein at least some of the one or more heaters are disposed in the outlet header.

5. The free cooling system of claim 1, wherein the circulation flow path includes a plurality of the outdoor heat exchangers of the free cooling system and an inlet header configured to distribute the process fluid to each of the plurality of outdoor heat exchangers.

6. The free cooling system of claim 5, wherein at least some of the one or more heaters are disposed in the inlet header.

7. The free cooling system of claim 1, further comprising a temperature sensor provided in the circulation flow path and a controller configured to control the one or more heaters such that the process fluid in the circulation flow path is maintained at a temperature greater than a freezing temperature of the process fluid.

8. The free cooling system of claim 7, wherein the temperature sensor is downstream of the one or more outdoor heat exchangers with respect to flow of the process fluid in the circulation flow path.

9. A method of operating a free cooling system, comprising:

when the free cooling system is in a deactivated state, circulating at least some of a process fluid of the free cooling system through a circulation flow path including one or more outdoor heat exchangers of the free cooling system, a pump, and one or more heaters, the circulating of the process fluid includes circulating the process fluid through the one or more outdoor heat exchangers, and operating the one or more heaters to heat said at least some of the process fluid.

10. The method of claim 9, further comprising closing one or more isolation valves such that the circulation flow path is isolated from a free cooling flow path of the free cooling system.

11. The method of claim 10, wherein closing the one or more isolation valves is performed when the free cooling system is deactivated from an activated state.

12. The method of claim 9, further comprising detecting a temperature of the process fluid in the circulation flow path using a temperature sensor, and wherein the operating of the one or more heaters is based on the temperature detected in the circulation flow path.

13. The method of claim 12, wherein the operating of the one or more heaters is further based on an ambient temperature of the free cooling system.

14. The free cooling system of claim 1, wherein the circulation flow path includes a heat exchanger of a mechanical thermal system, the heat exchanger configured to operate to exchange heat between a working fluid of the mechanical thermal system and the process fluid of the circulation flow path to cool the process fluid.

* * * * *